United States Patent [19]

Dover et al.

[11] 3,945,182

[45] Mar. 23, 1976

[54] TWISTING MACHINE FLYER BOW

[75] Inventors: Thomas J. Dover; Walter F. Thompson, both of Somerville, N.J.

[73] Assignee: General Cable Corporation, Greenwich, Conn.

[22] Filed: Nov. 19, 1974

[21] Appl. No.: 525,194

[52] U.S. Cl. ..... 57/58.52; 57/58.65; 57/67; 57/115

[51] Int. Cl.[2]. H01B 13/02; D01H 7/24; D01H 7/86

[58] Field of Search..... 57/58.52, 58.54, 58.55, 57/58.65, 58.67, 58.7, 58.83, 67–71, 115–117

[56] References Cited

UNITED STATES PATENTS

| | | | |
|---|---|---|---|
| 3,138,914 | 6/1964 | Blaisdell | 57/58.7 |
| 3,147,580 | 9/1964 | Blaisdell et al. | 57/58.7 |
| 3,309,857 | 3/1967 | Haugwitz | 57/58.52 X |
| 3,389,547 | 6/1968 | Kuhl | 57/117 |
| 3,481,126 | 12/1969 | Harvey | 57/58.52 X |
| 3,564,831 | 2/1971 | Bonnabaud et al. | 57/58.52 |
| 3,793,819 | 2/1974 | Madalozzo et al. | 57/58.52 |
| 3,812,666 | 5/1974 | Sarracino | 57/58.52 |

*Primary Examiner*—John Petrakes
*Attorney, Agent, or Firm*—Sandoe, Hopgood & Calimafde

[57] ABSTRACT

This flyer bow is for a machine used for twisting together communication cable wires to make conductor pairs, or twisting together large numbers of wires. The bow has a recess into which the twisted wires can nest and be held by centrifugal force in a position away from the windage caused by the rapid rotation of the bow in an orbital path. This prevents a loop from forming in the twisted wires as sometimes occurs in machines where windage overcomes the centrifugal force and wire tension. This invention permits operation of twisting machines with lower wire tension.

9 Claims, 5 Drawing Figures

FIG. 1.
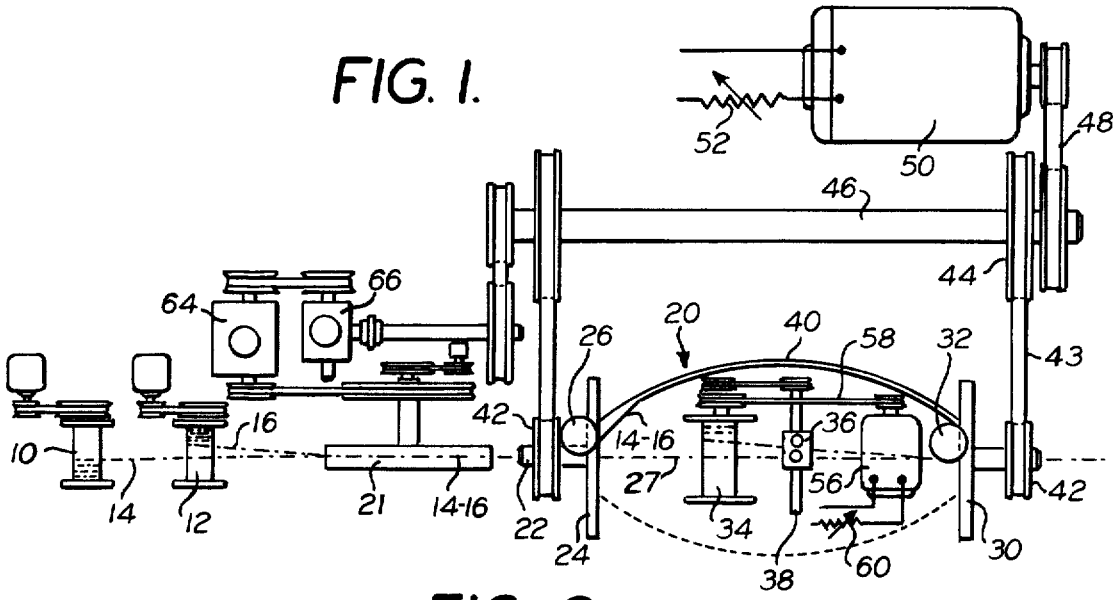
FIG. 2.
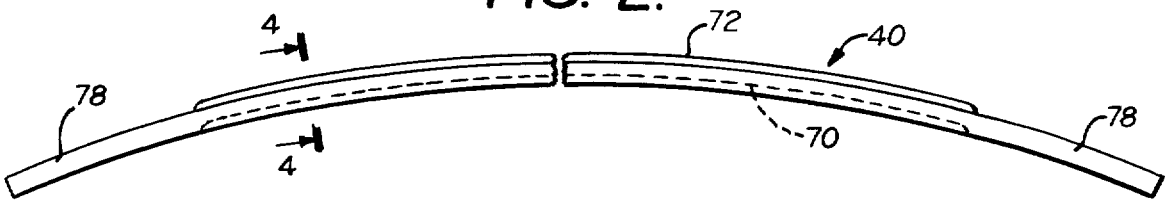
FIG. 3.
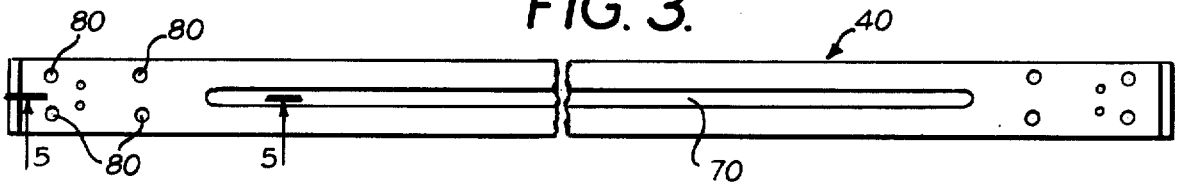
FIG. 4.
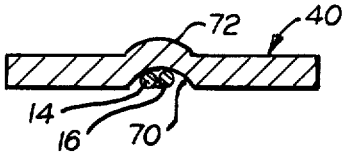
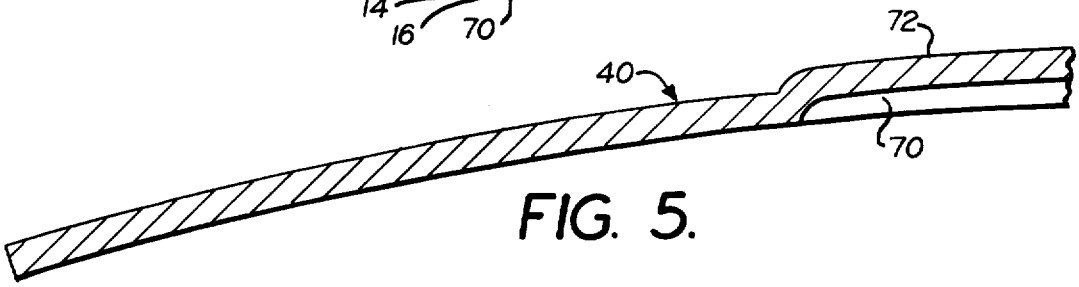
FIG. 5.

TWISTING MACHINE FLYER BOW

BACKGROUND AND SUMMARY OF THE INVENTION

Communication cables are made with large numbers of wires in a common core and often with wires twisted together to form pairs. Depending upon the amount of twisting, the pairs have their relationship along helical paths and the distance of the successive helixes constitute the "lay" of the pair.

The invention can be used for pairing, tripling, quadding, and bunching machines used for twisting wires. It will be described on a twisting machine for making pairs; the operation being similar where more wires are used. Wires are twisted to form pairs by passing them through twisting machines where the pairs of conductors are moved through orbital movement by a flyer bow which causes the conductors entering the flyer to be twisted. The flyer can also be constructed to impart additional twist and shorter lay to the pairs as they exit from the flyer.

One of the common problems encountered with twisting machines is that the windage caused by the rapid rotation of the flyer bow through its orbital path causes the conductors to be displaced from the bow and to accumulate a loop which may catch on adjacent structure and cause the wires to break.

In order to make it impossible for such windage to overcome the centrifugal force, that holds the conductors against the flyer bow, the construction of this invention provides a groove on the inner surface of the flyer bow; and this groove is deep enough to permit the conductors to nest into the groove out of the wind that sweeps across the surface of the bow as it rotates rapidly through its orbital path.

This invention provides a flyer bow which can be used on conventional twisting machines. The groove extends for most of the length of the bow but in the preferred embodiment it terminates short of the ends of the bow so that the ends can be constructed with the usual flat surfaces for connection with the end plates of a conventional twisting machine.

Other objects, features and advantages of the invention will appear or be pointed out as the description proceeds.

BRIEF DESCRIPTION OF DRAWING

In the drawing, forming a part hereof, in which like reference characters indicate corresponding parts in all the views:

FIG. 1 is a diagrammatic view of a wire twisting machine equipped with an improved flyer bow in accordance with this invention;

FIG. 2 is a side elevation, partly broken away, showing the flyer bow;

FIG. 3 is a plan view, partly broken away, of the inside face of the flyer bow shown in FIG. 2; and FIGS. 4 and 5 are greatly enlarged sectional views taken on the lines 4—4 and 5—5, respectively, of FIGS. 2 and 3, resepctively.

DESCRIPTION OF PREFERRED EMBODIMENT

There are two payoff reels 10 and 12 from which insulated communication conductors 14 and 16 are supplied to a twisting machine flyer 20 across a metering capstan 21.

The wires 14 – 16 pass through a hollow shaft 22 of an upstream rotor 24. Part of the upstream rotor 24 comprises a sheave 26 which acts as a guide around which the conductors 14 – 16 are deflected through an acute angle away from an axis of rotation 27 about which the flyer 20 rotates. The surface of the sheave 26, about which the conductors 14 and 16 pass, is tangent to the axis 27.

The flyer 20 has a downstream rotor 30 that rotates about the axis 26 at some longitudinal distance from the upstream rotor 24.

The downstream rotor 30 has a sheave 32 about which the conductors 14 – 16 pass and from which they are discharged along the axis 27 and at varying angles to the axis 27 to a takeup reel 34 on which the paired conductors are wound. The sheave 32, where the conductors 24 and 16 leave its guide surface, is substantially tangent with the axis 27.

A traversing guide 36 moves back and forth along a shaft 38 to apply the paired conductors 14 – 16 to the takeup reel 34 in even and successive layers.

A flyer bow 40 is attached at its opposite ends to the upstream rotor 24 and downstream rotor 30. The wires 14 – 16 pass along the inside surface of the flyer bow 40 as they travel from the guide sheave 26 to the second guide sheave 32. The opposite ends of the flyer bow 40 are detachably connected to the rotors 24 and 30, and these rotors are equipped with pulleys 42 driven by belts 43 from other pulleys 44 secured to a counter shaft 46. Counter shaft 46 is driven by a belt 48 from a motor 50 which has a speed control 52 for regulating the speed of the motor 52 and the resulting speed of rotation of the flyer 20.

The takeup reel 34 is driven by a motor 56, through a belt and pulley drive 58, to wind the wire on the reel 34 as fast as the wires come through the twisting machine. This motor 56 has a torque control 60. The speed of advance of the conductors 14 – 16 through the twisting machine is controlled by the rate of rotation of the metering capstan 21. The capstan 21 is driven from the motor 50 through motion transmitting connections including gear boxes 64 and 66 which can be adjusted to change the ratio of the wire feed to flyer speed. This correlation determines the amount of twist for a given length of wire and thereby controls the lay of the twist imparted to the pair of conductors 14 – 16.

From the construction illustrated, it will be apparent that the rotation of the flyer 20 causes the conductors 14 and 16 to twist about each other at a point just before the sheave 26.

The takeup reel 34, motor 56 and traversing guide 36, together with the motion transmitting means between these parts, are all carried in a floating cradle within the flyer; and this cradle does not rotate. This causes a second twist to the wires 14 – 16 as they approach the second sheave 32.

The structure thus far described is a conventional twisting machine and no further details of its construction are necessary for a complete understanding of this invention. No further description of the operating mechanism for the metering capstan 21 is necessary in connection with this invention.

FIGS. 2 and 3 show the bow 40. This bow is of arcuate shape in the direction of its length and is transversely substantially flat except for a groove 70 which is formed in the inside face; that is, the face of the flyer bow which faces toward the axis of rotation 27; and there is a corresponding ridge 72 on the opposite or outer side of the flyer bow 40, as best shown in FIG. 4. This depression on one side and protrusion on the other side has the effect of an embossed cross-section but the flyer bow may be made either by stamping the groove 70 and protrusion 72 as a reel embossment, or it may be made by molding the flyer bow to the desired cross-section.

The groove 70 is deep enough so that the twisted wires 14 – 16 can nest within the groove 70 where they are protected from the windage which sweeps transversely across the upper and lower surfaces of the flyer bow 40 as the flyer bow rotates rapidly along its orbital path. The centrifugal force on the wires 14 – 16, as the flyer rotates, holds the wires 14 – 16 against the inside surface of the bow 40 and down in the groove 70. With flyer bows of the prior art, this centrifugal force was sometimes insufficient to overcome the force of the windage and the twisted wires would be displaced on the flyer bow and form a loop in the wire which would cause the wire to break if the loop should catch on any structure located near the flyer bow. To avoid this displacement by windage, it was necessary to operate prior art twisting machines with more tension in the wire.

In order to make the bow 40 suitable for use on conventional twisting machines, the bow 40 has rectangular end portions 78 which are the same as those of conventional flyer bows. These rectangular end portions are obtained by having the groove 70 extend for only a portion of the length of the bow 40. The extent of the groove 70 is across the major portion of the bow 40 and across that part of the bow with which the conductors 14 and 16 contact. The ends 78 have the usual fastening openings 80 which are part of detachable fastening means for securing the flyer bow to the upstream and downstream rotors 24 and 30, respectively (FIG. 1).

The tension on the conductors 14 and 16 can be controlled by the amount of torque applied to the takeup spool 34 by the motor 56.

The reduced wire tension required by the grooved structure of the bow 40, for preventing displacement of the wires 14 and 16 by windage, is one of the outstanding advantages of the present invention. Increased tension in twisting machines is detrimental to the quality of the pairs of conductors that pass through the machine.

Flyer bows can be made of metal; but the preferred embodiment of this invention is a flyer bow made of "glass cloth" with epoxy resin and formed by vacuum bag molding. This produces a bow of very high strength in both tension, compression and flexure.

The preferred embodiment of the invention has been illustrated and described, but changes and modifications can be made, and some features can be used in different combinations without departing from the invention as defined in the claims.

What is claimed is:

1. A machine for twisting communication conductors together including in combination means for supplying the conductors to a twisting zone, a flyer that rotates about a longitudinal axis at the twisting zone, said flyer comprising a first guide at an upstream end of the flyer and around which the wires pass to a direction at an acute angle to the axis of rotation of the flyer, a second guide at a downstream end of the flyer and around which the wires are brought back into line with the axis of rotation of the flyer, means for advancing the wire under tension, a flyer bow extending along a generally arcuate path between the guides and having orbital movement around the axis of rotation of the flyer, the bow having one face which is the part of the bow that is closest to the axis of rotation, said face having a groove therein, extending lengthwise thereof, and which is a recessed part of said face and which is open to the ambient atmosphere, and with which the wires are held in contact by centrifugal force during their travel from one end of the flyer to the other during operation of the machine, and the groove being deep enough for the wires to nest therein and be shielded from the windage caused by the orbital movement of the bow whereby the wires remain in contact with the bow and protected from displacement and looping caused by transverse windage when the flyer is rotating.

2. The machine described in claim 1 characterized by each of the guides being a sheave, and both of the sheaves being substantially tangent to the axis of rotation of the flyer.

3. The machine described in claim 1 characterized by means for reeling the twisted conductors after they have passed through the flyer.

4. The machine described in claim 3 characterized by the means for reeling the twisted conductors comprising a spool, a power drive for the spool, the spool and power drive being located within the orbit traversed by the bow.

5. The machine described in claim 4 characterized by the spool and the driving means therefor being located on a support that remains stationery while the flyer rotates about it, whereby a second twist is imparted to the conductors as they advance from the flyer bow to the spool on which the twisted pair is reeled.

6. The machine described in claim 1 characterized by the bow being a one-piece strip of material of generally rectangular cross-section except at the groove and being of substantially the same thickness at the groove as along the length of the flyer beyond both sides of the groove.

7. The machine described in claim 6 characterized by the groove extending for most of the length of the bow, but terminating short of both ends of the bow, the ends of the bow beyond the groove having fastening means by which the bow is connected to rotating parts at opposite ends of the flyer.

8. The machine described in claim 1 including means for advancing the wires through the machine and means for rotating the flyer at a controlled speed with respect to the speed of the means for advancing the wires through the machine whereby the wire is twisted with a predetermined lay.

9. The machine described in claim 8 characterized by means for changing the ratio of the speed of the means for advancing the wire through the machine and the speed of rotation of the flyer to change the lay of the wire twisted by the machine.

* * * * *